US009611558B2

(12) United States Patent
Rao et al.

(10) Patent No.: US 9,611,558 B2
(45) Date of Patent: Apr. 4, 2017

(54) ELECTROLYTIC PRODUCTION OF POWDER

(71) Applicant: METALYSIS LIMITED, Rotherham (GB)

(72) Inventors: Kartik Rao, Sheffield (GB); James Deane, Grimsby (GB); Lucy Grainger, Sheffield (GB); John Clifford, Sydenham (GB); Melchiorre Conti, Sheffield (GB); James Collins, Doncaster (GB)

(73) Assignee: METALYSIS LIMITED (GB)

( * ) Notice: Subject to any disclaimer, the term of this patent is extended or adjusted under 35 U.S.C. 154(b) by 0 days.

(21) Appl. No.: 14/349,568

(22) PCT Filed: Oct. 4, 2012

(86) PCT No.: PCT/GB2012/052464

§ 371 (c)(1),
(2) Date: Apr. 3, 2014

(87) PCT Pub. No.: WO2013/050772

PCT Pub. Date: Apr. 11, 2013

(65) Prior Publication Data

US 2014/0231262 A1 Aug. 21, 2014

(30) Foreign Application Priority Data

Oct. 4, 2011 (GB) ..... 1117067.7
Apr. 30, 2012 (GB) ..... 1207520.6

(51) Int. Cl.

| | |
|---|---|
| ***C25C 3/28*** | (2006.01) |
| ***C25C 5/04*** | (2006.01) |
| ***C25C 7/02*** | (2006.01) |

(52) U.S. Cl.
CPC ..... *C25C 3/28* (2013.01); *C25C 5/04* (2013.01); *C25C 7/025* (2013.01)

(58) Field of Classification Search
CPC ..... C25C 3/28; C25C 5/04
See application file for complete search history.

(56) References Cited

U.S. PATENT DOCUMENTS

2003/0047462 A1* 3/2003 Ward-Close ..... B22F 9/20 205/366
2004/0219087 A1* 11/2004 Mohri ..... C01B 13/14 423/263

(Continued)

FOREIGN PATENT DOCUMENTS

GB WO 2010130995 A1 * 11/2010 ..... C22B 4/08
WO WO 01/62996 8/2001

(Continued)

OTHER PUBLICATIONS

Mo et al. "Electronic and optical properties of three phases of titanium dioxide: Rutile, anatase, and brookite" Physical Review B. May 15, 1994. vol. 51, Issue 19. pp. 13 023-13 032.*

(Continued)

*Primary Examiner* — Steven A. Friday
(74) *Attorney, Agent, or Firm* — Saliwanchik, Lloyd & Eisenschenk

(57) ABSTRACT

A method of producing metallic powder comprises steps of arranging a volume of feedstock comprising a plurality of non-metallic particles within an electrolysis cell, causing a molten salt to flow through the volume of feedstock, and applying a potential between a cathode and an anode such that the feedstock is reduced to metal. In preferred embodiments the feedstock is a plurality of discrete powder particles and these particles are reduced to a corresponding (Continued)

Figure 1:
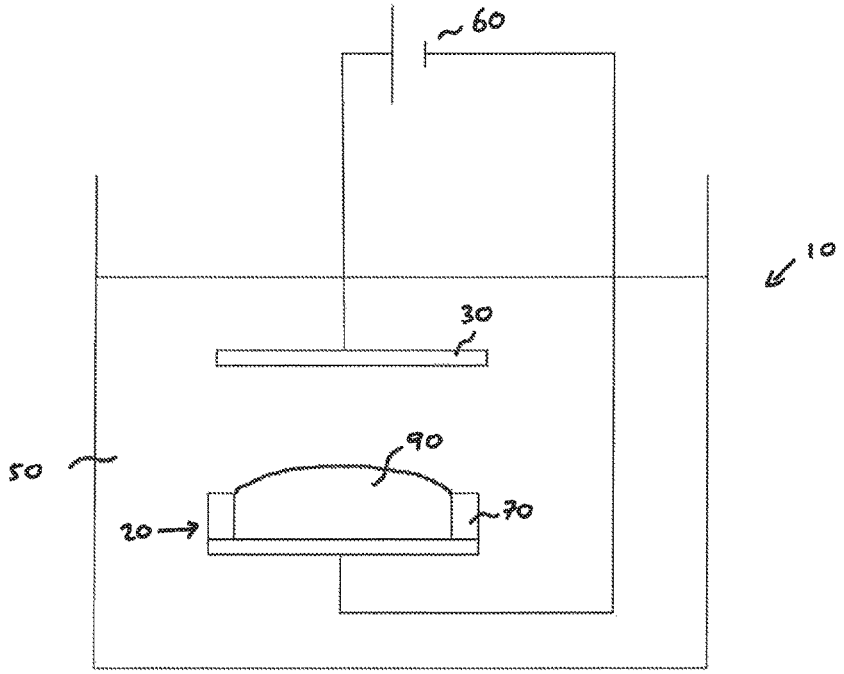

plurality of discrete metallic particles. In advantageous embodiments, the feedstock may be sand.

34 Claims, 4 Drawing Sheets

(56) References Cited

U.S. PATENT DOCUMENTS

| | | | | |
|---|---|---|---|---|
| 2005/0050989 | A1* | 3/2005 | Osborn | C22B 34/129 75/10.62 |
| 2005/0166706 | A1* | 8/2005 | Withers | C22B 34/1281 75/10.23 |
| 2006/0226027 | A1* | 10/2006 | Shook | C22B 34/129 205/766 |

FOREIGN PATENT DOCUMENTS

| | | |
|---|---|---|
| WO | WO 02/40748 | 5/2002 |
| WO | WO 2005/038092 | 4/2005 |
| WO | WO 2010/092358 | 8/2010 |
| WO | WO 2010/146369 | 12/2010 |

OTHER PUBLICATIONS

Suzuki, R. et al. "Calciothermic Reduction of Titanium Oxide and in-situ Electrolysis in Molten $CaCl_2$" *Metallurgical & Materials Trans. B*, 2003, 34(3):287-295.

Zhang, S. and Nicol, M. "An electrochemical study of the reduction and dissolution of ilmenite in sulfuric acid solutions" *Hydrometallurgy*, 2009, 97:146-152.

* cited by examiner

ELECTROLYTIC PRODUCTION OF POWDER

CROSS-REFERENCE TO RELATED APPLICATION

This application is the National Stage of International Application Number PCT/GB2012/052464, filed Oct. 4, 2012, which is hereby incorporated by reference herein in its entirety, including any figures, tables, nucleic acid sequences, amino acid sequences, or drawings.

The invention relates to a method for producing metallic powder using electrolysis reduction processes such as electro-decomposition.

BACKGROUND

The present invention concerns a method for the reduction of a feedstock comprising a metal compound or compounds, such as a metal oxide, to form a reduced product. As is known from the prior art, electrolytic processes may be used, for example, to reduce metal compounds or semi-metal compounds to metals, semi-metals, or partially reduced compounds, or to reduce mixtures of metal compounds to form alloys. In order to avoid repetition, the term metal will be used in this document to encompass all such products, such as metals, semi-metals, alloys, intermetallics, and partially reduced products.

In recent years, there has been great interest in the direct production of metal by direct reduction of a solid feedstock, for example, a metal-oxide feedstock. One such direct reduction process is the Cambridge FFC® electro-decomposition process (as described in WO 99/64638). In the FFC process, a solid compound, for example a metal oxide, is arranged in contact with a cathode in an electrolysis cell comprising a fused salt. A potential is applied between the cathode and an anode of the cell such that the compound is reduced. In the FFC process, the potential that produces the solid compound is lower than a deposition potential for a cation from the fused salt.

Other reduction processes for reducing feedstock in the form of a cathodically connected solid metal compound have been proposed, such as the Polar® process described in WO 03/076690 and the process described in WO 03/048399.

Conventional implementations of the FFC process and other solid-state electrolytic reduction processes typically involve the production of a feedstock in the form of a porous preform or precursor, fabricated from a sintered powder of the solid compound to be reduced. This porous preform is then painstakingly coupled to a cathode to enable the reduction to take place. Once a number of preforms have been coupled to the cathode, then the cathode can be lowered into the molten salt and the preforms can be reduced. During reduction of many metal oxides, for example titanium dioxide, the individual particles making up the preform undergo further sintering forming a solid mass of metal, which may have entrapped salt.

It may sometimes be desirable to produce metallic powder, for example powder for subsequent processing using various known powder metallurgy techniques. Powder has previously been produced by a processing route involving direct reduction of solid preforms, such as pellets, to form solid pellets of reduced metal. After reduction, these reduced pellets may be crushed or ground to form powder of a desired particle size. Some metals such as titanium are difficult to comminute to powder without undergoing additional steps such as hydrogen deprecation.

SUMMARY OF THE INVENTION

The invention provides a method for producing metallic powder as defined in the appended independent claim, to which reference should now be made. Preferred or advantageous features of the invention are set out in various dependent sub-claims.

Thus, in a first aspect a method for producing metallic powder may comprise the steps of arranging a cathode and an anode in contact with a molten salt within an electrolysis cell, arranging a volume of feedstock comprising a plurality of non-metallic particles within the electrolysis cell, causing a molten salt to flow through the volume of feedstock, and applying a potential between the cathode and the anode such that the feedstock is reduced to metal.

In a second aspect, a method for producing metallic powder may comprise the steps of arranging a cathode and an anode in contact with a molten salt within an electrolysis cell, an upper surface of the cathode supporting a feedstock comprising a plurality of non-metallic particles, and a lower surface of the anode being vertically spaced from the feedstock and the cathode, and applying a potential between the cathode and the anode such that the feedstock is reduced to metal.

In a third aspect, a method for producing metallic powder may comprise the steps of arranging a cathode and an anode in contact with a molten salt within an electrolysis cell, an upper surface of the cathode supporting a free-flowing feedstock comprising a plurality of discrete non-metallic particles, and a lower surface of the anode being vertically spaced from the feedstock and the cathode, and applying a potential between the cathode and the anode such that the feedstock is reduced to a plurality of discrete metal particles.

A method for producing metallic powder may involve a combination of the features set out in two or more of these aspects. The following preferred or advantageous features may be used in conjunction with any aspect described above. Preferred and advantageous features may be combined in any permutation or combination.

It is preferred that the feedstock is a free-flowing powder comprising a plurality of separate discrete particles of feedstock material. The use of free-flowing particles, for example free-flowing powder particles, as a feedstock may provide considerable advantage over prior art electro-decomposition methods that have required a powdered non-metallic feedstock to be formed into a porous perform or precursor prior to reduction. Preferably, individual particles in the feedstock are reduced to individual particles of metal. Preferably, there is substantially no alloying between separate particles. Preferably, there is substantially no sintering between adjacent feedstock particles during reduction.

In the prior art, powder has been formed by reducing pellets of oxide material (each pellet formed by consolidation of thousands of individual oxide particles) into pellets of metal. These metal pellets have then been crushed to form metal powder. The inventors have determined that, contrary to previous understanding, it is possible to reduce a feedstock comprising discrete particles of feedstock material into a powder comprising discrete particles of metal material. Not only is the step of preparing feedstock preforms eliminated (which was previously understood to be essential), but there is no need to crush reduced pellets to form a commercially usable metallic powder.

Advantageously, the feedstock may be a naturally occurring sand or fine gravel or may comprise free-flowing particles derived from a naturally occurring sand or very fine gravel. The sand or gravel may be a beneficiated sand or gravel. Sands and gravels may contain one or more metallic ore minerals, either as whole particles or as crystallites within particles. Such minerals may be reduced using a process according to the invention to extract the metallic component. For example, the feedstock may derive from a naturally occurring rutile sand. Rutile is the most common naturally occurring titanium dioxide polymorph.

The feedstock may comprise particles derived from crushed rock, for example a crushed ore. The feedstock may comprise particles derived from a crushed slag, for example a slag formed by heating a mineral sand or ore.

Advantageously, the feedstock may comprise a naturally occurring mineral. For example, the feedstock may comprise a naturally occurring sand such as rutile or ilmenite. Such natural sands comprise many particles, each of which may have a different composition. Such sands may also comprise multiple grains of different mineral types.

Advantageously, the feedstock may comprise a first non-metallic particle having a first composition and a second non-metallic particle having a second composition. The feedstock may then be reduced under conditions such that the first non-metallic particle is reduced to a first metallic particle having a first metallic composition and the second non-metallic particle is reduced to a second metallic particle having a second metallic composition. In the prior art, experiments are described in which metal oxide particles of different compositions are blended, formed into a preform, and reduced. The resulting metal product is an alloy. Thus, it would be expected that the result of reducing a particulate feedstock comprising particles of different compositions would be an alloy. Surprisingly, it has proved possible to reduce a feedstock comprising multiple particles having different compositions to a metallic powder comprising multiple particles of different compositions, with apparently no alloying between separate individual particles. There may be significant benefits in being able to reduce a free-flowing feedstock in this way. For example, the invention may make the production of metal by direct reduction of naturally occurring minerals as found in ores and sands both practically and economically viable.

As sands are likely to consist of more than two particles having a different composition, the reduction may occur such that each different particle is individually reduced to metal. Thus, in an advantageous embodiment it may be said that the feedstock further comprises an nth non-metallic particle having an nth composition, the nth non-metallic particle being reduced to an nth metallic particle having an nth metallic composition. The term "n" may be any whole number.

Titanium is an element that occurs in many naturally occurring minerals. Thus, the feedstock may advantageously comprise a high proportion of titanium, and the resulting reduced metal may then comprise a high proportion of titanium.

There are a number of different scales for classifying particulate materials according to particle size. On the Wentworth scale, for example, sand is classified as ranging from 62.5 microns to 125 microns in diameter (very fine sand), 125 microns to 250 microns in diameter (fine sand), 250 microns to 500 microns in diameter (medium sand), 500 microns to 1 mm in diameter (coarse sand) and 1 mm to 2 mm in diameter (very coarse sand). Very fine gravel is defined as particles ranging from 2 mm in diameter to 4 mm in diameter. Particles of material, and particularly particles of sand, are rarely perfect spheres. In practice individual particles may have different lengths, widths, and breadths. For convenience, however, particle sizes are usually stated as a single diameter, which is approximately correct providing the particles do not have an excessively high aspect ratio. Sands and gravels may be described by a single average particle size for the purposes of this invention.

Preferably, a feedstock suitable for use in an embodiment of the invention substantially comprises free-flowing particles of between 62.5 microns and 4 mm in diameter. Particularly preferably, the feedstock comprises free-flowing particles of a size that would be classed as sand on the Wentworth scale. Particularly preferably the feedstock comprises free-flowing particles of a size that would be classed as fine sand or medium sand on the Wentworth scale.

Average particle size may be determined by a number of different techniques, for example by sieving, laser diffraction, dynamic light scattering, or image analysis. While the exact value of the average particle size of a sample of sand may differ slightly depending on the measurement technique used to determine the average value, in practice the values will be of the same order providing the particles do not have an excessively high aspect ratio. For example, the skilled person will appreciate that the same sand may be found to have an average particle diameter of perhaps 1.9 mm if analysed by sieving, but 2.1 mm if analysed by a different technique, such as image analysis.

The particles making up the feedstock preferably have an average particle diameter of lower than 10 mm, for example lower than 5 mm, preferably in which the average particle diameter is between 10 microns and 5 mm, more preferably between 20 microns and 4 mm, or between 60 microns and 3 mm, or between 250 microns and 2.5 mm, or between 500 microns and 2 mm. A particularly preferred feedstock may have an average particle diameter of between 60 microns and 2 mm, preferably between 100 microns and 1.75 mm, for example between 250 microns and 1.5 mm or between 100 and 250 microns.

It is preferred that the average particle diameter is determined by laser diffraction. For example, the average particle size could be determined by an analyser such as the Malvern Mastersizer Hydro 2000MU.

It may be desirable to specify the range of particle size in a feedstock. A feedstock containing particles that vary in diameter over a wide range may pack more densely than a feedstock in which the majority of the particles are of substantially the same particle size. This may be due to smaller particles filling interstices between adjacent larger particles. It may be desirable that a volume of a feedstock has sufficient open space or voidage for a molten salt to flow freely through a bed formed by the feedstock. If the feedstock packs too densely, then the molten salt flow-path through the feedstock may be inhibited.

Particle size range may be determined by laser diffraction. For example, the particle size range could be determined by an analyser such as the Malvern Mastersizer Hydro 2000MU.

It may be convenient to select a feedstock size range by a process of sieving. The selection of size ranges or size fractions of particles by sieving is well known. It is preferred that the feedstock comprises free-flowing particles within a size range of 63 microns to 1 mm as determined by sieving. It may be particularly preferred that the feedstock comprises free-flowing particles within a size range of 150 microns to 212 microns as determined by sieving.

The particle density or true density of a particulate solid or powder is an intrinsic physical property of a material. It is the density (mass per unit volume) of the individual particles that make up the powder. In contrast, bulk density is a measure of the average density of a large volume of the powder in a specific medium (usually air).

The measurement of particle density can be done in a number of standard ways—most commonly based on the Archimedes' principle. The most widely used method entails the powder being placed inside a container (a pycnometer) of known volume, and weighed. The pycnometer is then filled with a fluid of known density, in which the powder is not soluble. The volume of the powder is determined by the difference between the volume as shown by the pycnometer, and the volume of liquid added (i.e. the volume of air displaced).

Bulk density is not an intrinsic property of a powdered or particulate material; it is a property that can change depending on how the material is handled.

It is defined as the mass of many particles of the material divided by the total volume they occupy. The total volume includes particle volume, inter-particle void volume and internal pore volume.

Dry bulk density=mass of powder/volume as a whole $$\rho_b = \frac{M_s}{V_t}$$

The bulk density of a mineral sand or ore concentrate depends greatly on the mineral make up of the sand and the degree of compaction. The bulk density has different values depending on whether it is measured in the as-poured, freely settled, condition, or in a compacted state (known as a settled or tapped condition).

For example, a powder poured in to a container will have a particular bulk density; if the container is disturbed, the powder particles will move and usually settle closer together, resulting in a higher bulk density. For this reason, the bulk density of powders is usually reported both as "freely settled" (or "as-poured" density) and "tapped" density (where the tapped density refers to the bulk density of the powder after a specified compaction process, usually involving vibration of the container.)

As used herein, a volume of bulk feedstock refers to a volume of particulate feedstock in the as-poured condition. For example, a volume of feedstock may be a volume of a sand feedstock that is in the as-poured condition and has not been compressed or deliberately agitated. The volume of the feedstock includes the volumes of each individual particle making up the feedstock and the voids or interstices between those particles.

As used herein, bulk density of a feedstock refers to the density calculated by dividing the total mass of feedstock by its volume. Bulk density may be determined, for example, by pouring the feedstock into a receptacle of known volume until that receptacle is filled, determining the mass of the particles within the volume, and calculating the density.

As used herein, a tapped feedstock is a volume of particulate feedstock that has been poured and then compressed, agitated or tapped to induce settling of the feedstock. A volume of a tapped feedstock would be referred to as a tapped volume. A tapped density would be calculated using the mass of a powder and a tapped volume.

As used herein, the voidage of a feedstock (as-poured or tapped) refers to the proportion of the feedstock that is free space between particles making up the feedstock, and is expressed as a percentage of the bulk volume. The voidage can be determined by comparing the density of the feedstock with the theoretical density of particles of the feedstock material. The skilled person will be aware of methods for determining voidage of different feedstocks.

The inventors have noted that the voidage of a feedstock may contribute to the ability of the feedstock to reduce as individual particles. For example, an experimental reduction was carried out involving a rutile feedstock having a particle size distribution of between 150 microns and 212 microns (determined by sieving) and a bulk density of 2.22 $gcm^{-3}$ (the rutile density was assumed to be 4.23 $gcm^{-3}$, which is the theoretical density of titanium dioxide). Therefore, in the as-poured condition this feedstock had a voidage of 47%. A portion of this feedstock, when arranged in a suitable electrolysis apparatus in an as-poured condition, reduced to individual particles of Ti-based metal. By contrast, the same rutile feedstock, when settled by tapping, had a tapped density of 2.44 $gcm^{-3}$ and a tapped voidage of 42%. A portion of this feedstock, when arranged in the electrolysis apparatus, settled, and reduced under the same conditions as the as-poured feedstock, formed a sintered mass of Ti-based metal.

Thus, for use in any aspect of the present invention it is preferred that the feedstock is a volume of bulk feedstock (i.e. in the as-poured or freely settled condition) and not a tapped feedstock. It is preferred that the volume of bulk feedstock has a voidage of greater than 43% to facilitate flow of molten salt through the feedstock. It may be preferred that a volume of bulk feedstock has a voidage of between 44% and 54%. Preferably the voidage is between 45% and 50% for example between 46% and 49% or between 47% and 48%.

One standard way of defining the particle size distribution in a sample of particles is to refer to D10, D50 and D90 values. D10 is the particle size value that 10% of the population of particles lies below. D50 is the particle size value that 50% of the population lies below and 50% of the population lies above. D50 is also known as the median value. D90 is the particle size value that 90% of the population lies below. A feedstock sample that has a wide particle size distribution will have a large difference between D10 and D90 values. Likewise, a feedstock sample that has a narrow particle size distribution will have a small difference between D10 and D90.

Particle size distribution may be determined by laser diffraction. For example, the particle size distribution, including D10, D50 and D90 values, could be determined by an analyser such as the Malvern Mastersizer Hydro 2000MU.

It may be preferable that D10 for any feedstock is greater than 60 microns and D90 is lower than 3 mm. It may be preferable that D90 is no more than 200% greater than D10, preferably no more than 150% greater than D10, or no more than 100% greater than D10. It may be beneficial if the feedstock has a size distribution in which D90 is no more than 75% greater than D10 or no more than 50% greater than D10.

D10 is preferably between 0.25 and 1 mm. D90 is preferably between 0.5 mm and 3 mm.

One embodiment of a feedstock may have a population of particles in which D10 is 1 mm and D90 is 3 mm. Another embodiment of a feedstock may have a population of particles in which D10 is 1.5 mm and D90 is 2.5 mm. Another embodiment of a feedstock may have a population in which D10 is 250 microns and D90 is 400 microns.

Another embodiment may have a population in which D10 is 0.5 mm and D90 is 0.75 mm.

In addition to allowing a more open bed of feedstock to form, the particles in a feedstock which has a narrow particle size distribution may also all reduce at approximately the same rate. It may advantageously help prevent sintering of individual particles if the reduction for the particles in the feedstock finishes at approximately the same time.

As the flow of molten salt through the bed may be important it may be desirable to specify a voidage for a bed formed from a volume of the feedstock. For example, it may be desirable to specify that the bed has greater than 40% voidage or greater than 45% voidage.

Preferably the volume of feedstock is located on a mesh, which is preferably positioned substantially horizontally, through which molten salt may flow. For example, the upper surface of a cathode that retains the volume of feedstock may be in the form of, or comprise, a mesh. Preferably, the feedstock is retained by such a mesh having a mesh size smaller than an average particle size of the feedstock. Particularly preferably, the mesh has a mesh size equal to or smaller than the D10 value for the feedstock population. The mesh size may be smaller than D5. The particulate feedstock may be supported on the surface of the mesh and molten salt may then be able to flow through the mesh and the bed of feedstock. Movement of salt through a mesh may, advantageously, gently agitate the particles and help prevent individual particles from sintering together. It is not desirable, however, for the movement of salt to cause the feedstock to become fluidised, or to carry individual particles away from the mesh.

Preferably, the volume of feedstock is retained at its edges by a suitable retaining barrier, such as a peripheral barrier. For example, a cathode used to support a feedstock may comprise a retaining barrier allowing feedstock to be supported on its upper surface. It is preferable that the feedstock is loaded onto the cathode to a depth of greater than 5 mm, preferably greater than 1 cm or greater than 2 cm. The depth of the feedstock may depend to a great degree on the size of the particles to be reduced. However, in a batch process in which feedstock loaded onto a cathode is reduced, the lower the feedstock depth the lower the yield of metal in any particular run or batch.

Examples of minerals capable of yielding high value metals that may be found in naturally occurring sands and oxide ores include, rutile, ilmenite, anatase, and leucoxene (for titanium), scheelite (tungsten), cassiterite (tin), monazite (cerium, lanthanum, thorium), zircon (zirconium hafnium and silicon), cobaltite (cobalt), chromite (chromium), bertrandite and beryl (beryllium, aluminium, silicon), uranite and pitchblende (uranium), quartz (silicon), molybdenite (molybdenum and rhenium) and stibnite (antimony). One or more of these minerals may be suitable as a component of a feedstock for use in the present invention. This list of minerals is not exclusive. The invention may be used to reduce particles of material, for example sands or crushed ores, that contain one or more minerals not listed above.

Advantageously, the particles making up the feedstock may be substantially free from porosity, for example, being greater than 90% dense or being greater than 95% dense. The prior art electro-decomposition methods have used porous feedstock. Substantially all of the grains or particles making up many powder feedstocks may be fully dense, for example powdered feedstocks derived from most naturally occurring sands or from crushed ore. As used herein, the term fully dense means substantially free from porosity.

The particles making up the feedstock may have an absolute density of between 3.5 g/cm$^3$ and 7.5 g/cm$^3$, preferably between 3.75 g/cm$^3$ and 7.0 g/cm$^3$, for example between 4.0 g/cm$^3$ and 6.5 g/cm$^3$, or between 4.2 g/cm$^3$ and 6.0 g/cm$^3$. Many minerals and oxides of metals, particularly the heavy metals have a high density. Many naturally occurring minerals containing titanium, zirconium, and iron fall into this category.

Minerals containing some of the heavy elements, for example U, Th, or Ta, may have a density that is greater than 7.5 g/cm$^3$. For example, pitchblende and uranite may have densities of up to 11 g/cm$^3$. Embodiments of the present invention may be used to reduce particles containing such high density minerals. Likewise, minerals containing lighter elements, for example Si, may have a density that is lower than 3.5 g/cm$^3$. For example, silica may have a density that is about 2.6 g/cm$^3$. Embodiments of the present invention may be used to reduce particles containing such low density minerals.

The feedstock may comprise a synthetic mineral or a treated mineral. For example, in order to produce a titanium powder the feedstock may be formed entirely or in part from a synthetic rutile material. One method of forming a synthetic rutile may be by treatment of ilmenite.

Ilmenite is a mineral having a nominal composition of $FeTiO_3$. Reduction of natural ilmenite particles may yield a ferro-titanium alloy powder. However, it is known that ilmenite can be treated to form a synthetic rutile of nominal composition $TiO_2$ by removing the iron constituent. Such synthetic rutiles are produced for use in the pigment industry. Methods of treating ilmenite to produce synthetic rutile generally involve leaching in an acid or alkali to remove impurities and unwanted elements such as iron. Such methods of producing synthetic rutile are well known in the art. In practice, the most common commercial processes for treating ilmenite to produce synthetic rutile are the Becher process, Benilite process, Austpac process, and Ishihara process.

Synthetic rutile is a porous particle produced by chemical leaching. This may be particularly advantageous in facilitating control over the porosity of the reduced metallic particle. Synthetic rutile is used to form titanium. Other synthetically produced materials may be used to form other metallic powders.

The feedstock may comprise porous particles, for example, in which the particles making up the feedstock have a porosity of between 10% and 50%. Some natural sands and ores are porous, as are some synthetic minerals. The degree of porosity in the reduced particles may be influenced by the degree of porosity in the feedstock. It may be advantageous to form a powder comprising or consisting of porous metallic particles.

Individual crystals that form part of a polycrystalline solid are often termed crystallites or grains. Within each crystallite, atoms are arranged in a regular ordered pattern. Boundaries between adjacent crystallites (crystallite boundaries or grain boundaries) are disordered. Preferably, the particles making up a feedstock are crystalline and have an average crystallite size of greater than 10 micrometers, and more preferably greater than 25 micrometers, or greater than 50 micrometers, or greater than 100 micrometers. Many chemical compounds, such as chemically purified "synthetic" oxides, are formed by processes such as chemical precipitation or condensation. Although particles formed may be many hundreds of micrometers in diameter, the crystallite size of such synthetic materials is typically of the order of a few tens of nanometers. It may be advantageous, however, for the crystallite size to be significantly higher, for example of the order of tens, or hundreds, of micrometers.

Because boundaries between crystallites have a highly defective structure, diffusion occurs more readily at these boundaries. If a feedstock particle has a fine crystallite structure then the volume of crystallite boundaries within that particle will be greater than if the particle had a coarser crystallite structure. Diffusion is one of the factors that controls the degree of sintering between adjacent particles in a feedstock, for example during electro-reduction. An electro-reduction reaction involving powdered material with a large crystallite size may, therefore, be more controllable than if the feedstock has a fine crystallite size. Individual particles of a feedstock may be less prone to sintering together (so as to produce a free-flowing metal powder product) if the crystallite size is of, or tends towards, a similar magnitude to the particle size, such as being on average greater than a tenth, a quarter or half of the particle size. For example, the average crystallite size may be greater than 10% of the average particle size or greater than 20% of the average particle size or greater than 30% of the average particle size or r greater than 50% of the average particle size.

Advantageously, the feedstock may comprise a first set of particles having a composition in which a first metallic element forms the greater proportion by mass, and a second set of particles in which a second metallic element forms the greater proportion by mass. Preferably, the feedstock is reduced using a method embodying the invention such that there is no alloying between the first set of particles and the second set of particles. Parameters such as temperature of the molten salt, and reduction time may be controlled in order to reduce the feedstock such that individual grains of the reduced material do not irreversibly bond together.

Prior art electro-decomposition methods teach the use of preforms moulded and sintered from particulate feedstock and individually coupled to a cathode. Where a powdered feedstock is used in its unprocessed form, it would not be practical to ensure that each powder particle could contact a portion of a cathode. In embodiments of the present invention, it is preferred that the feedstock particles, which have an average diameter, are loaded onto a surface or into a fine-mesh basket to a depth of between 10 and 500 times the average particle diameter of the feedstock. For example, feedstock may be loaded onto the upper surface of a cathode to a depth of between 10 and 500 times the average feedstock particle diameter.

The reduction time is advantageously as low as possible, to limit or prevent sintering of individual particles of the metal product. Advantageously, the reduction time may be lower than 100 hours, preferably lower than 60 hours or lower than 50 hours. Particularly preferably the reduction time is lower than 40 hours.

The salt temperature is advantageously as low as possible, to limit or prevent sintering of individual particles of the metal product. Preferably, the molten salt temperature during reduction is maintained to be lower than 1100° C., for example lower than 1000° C., or lower than 950° C., or lower than 900° C.

Advantageously, the feedstock may be reduced with substantially no sintering between individual particles such that a metallic powder can be recovered having an average diameter of slightly lower than an average diameter of the particles making up the feedstock. The reason that the metallic particles are typically slightly smaller than the feedstock particles is that the feedstock particles tend to have a ceramic structure that includes a non-metallic element such as oxygen or sulphur, whereas the reduced particles have a metallic structure from which much of this non-metallic element has been removed.

The reduced feedstock may form a friable mass of individual metallic particles. Advantageously, such a friable mass may be easily broken up to form a free-flowing metallic powder. Preferably, substantially every particle forming the metallic powder corresponds to a non-metallic particle from the feedstock.

The methods according to various embodiments of the invention described above may be particularly suitable for the production of metal powder by the reduction of a solid feedstock comprising particles of metal oxide or metal oxides. Pure metal powders may be formed by reducing pure metal oxides, and alloy powders and intermetallics may be formed by reducing feedstocks comprising particles of mixed metal oxides. Preferably metal powders formed by processes embodying the invention have an oxygen content of lower than 5000 ppm, preferably lower than 4000 ppm, or lower than 3,500 ppm.

Some reduction processes may only operate when the molten salt or electrolyte used in the process comprises a metallic species (a reactive metal) that forms a more stable oxide than the metallic oxide or compound being reduced. Such information is readily available in the form of thermodynamic data, specifically Gibbs free energy data, and may be conveniently determined from a standard Ellingham diagram or predominance diagram or Gibbs free energy diagram. Thermodynamic data on oxide stability and Ellingham diagrams are available to, and understood by, electrochemists and extractive metallurgists (the skilled person in this case would be well aware of such data and information).

Thus, a preferred electrolyte for an electrolytic reduction process may comprise a calcium salt. Calcium forms a more stable oxide than most other metals and may therefore act to facilitate reduction of any metal oxide that is less stable than calcium oxide. In other cases, salts containing other reactive metals may be used. For example, a reduction process according to any aspect of the invention described herein may be performed using a salt comprising lithium, sodium, potassium, rubidium, caesium, magnesium, calcium, strontium, barium, or yttrium. Chlorides or other salts may be used, including mixture of chlorides or other salts.

By selecting an appropriate electrolyte, almost any metal oxide particles may be capable of reduction using the methods and apparatuses described herein. Naturally occurring minerals containing one or more such oxides may also be reduced. In particular, oxides of beryllium, boron, magnesium, aluminium, silicon, scandium, titanium, vanadium, chromium, manganese, iron, cobalt, nickel, copper, zinc, germanium, yttrium, zirconium, niobium, molybdenum, hafnium, tantalum, tungsten, and the lanthanides including lanthanum, cerium, praseodymium, neodymium, samarium, may be reduced, preferably using a molten salt comprising calcium chloride.

The skilled person would be capable of selecting an appropriate electrolyte in which to reduce a particular metal oxide, and in the majority of cases an electrolyte comprising calcium chloride will be suitable.

Preferably, the reduction occurs by an electro-decomposition or electro-deoxidation process such as the FFC Cambridge process or the BHP Polar process and the process described in WO03/048399.

SPECIFIC EMBODIMENT OF THE INVENTION

Figure 2A:
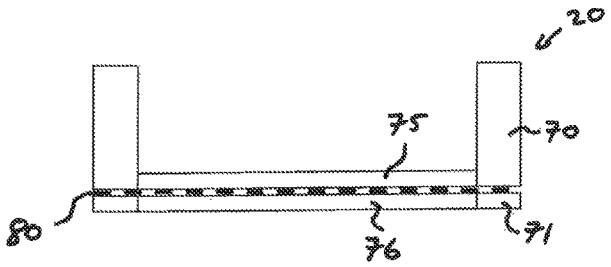
Figure 2B:
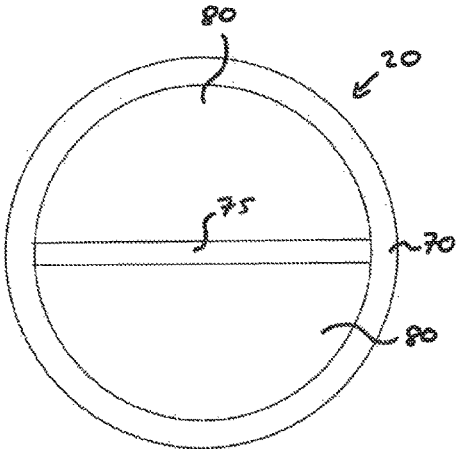
Figure 3:
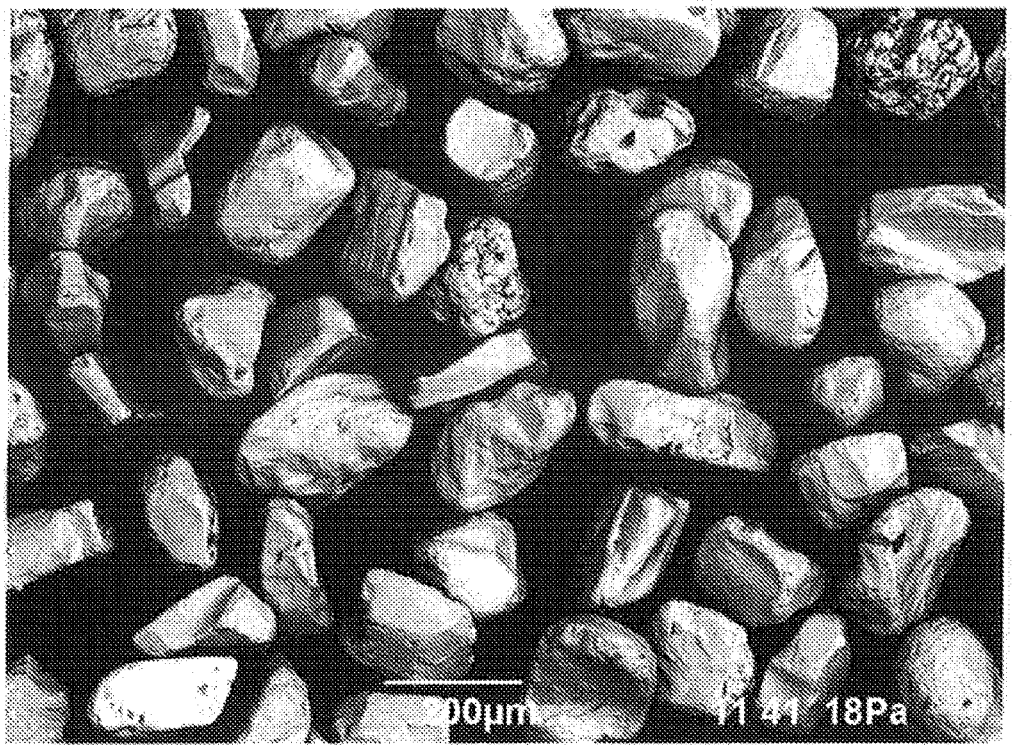
Figure 4:
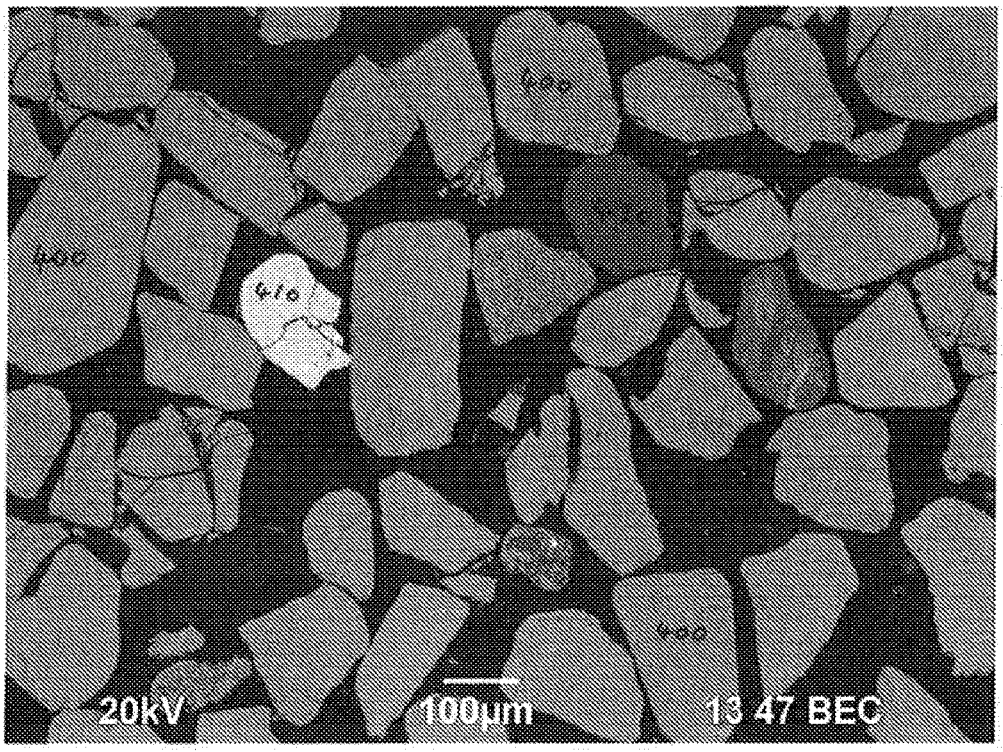
Figure 5:
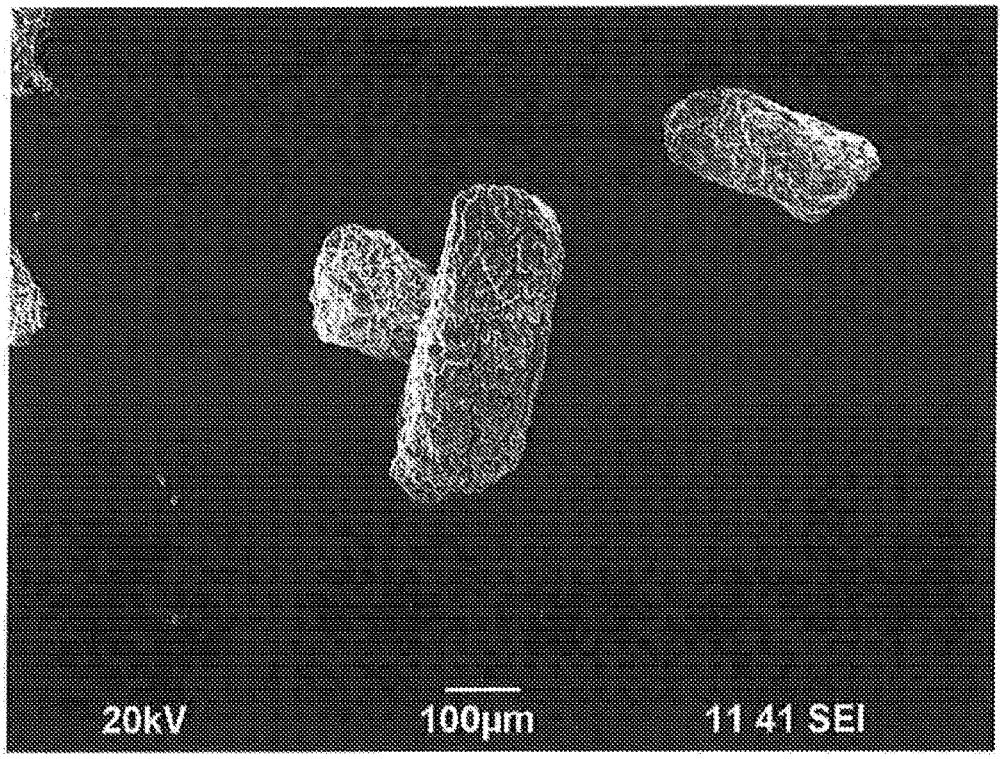
Figure 6:
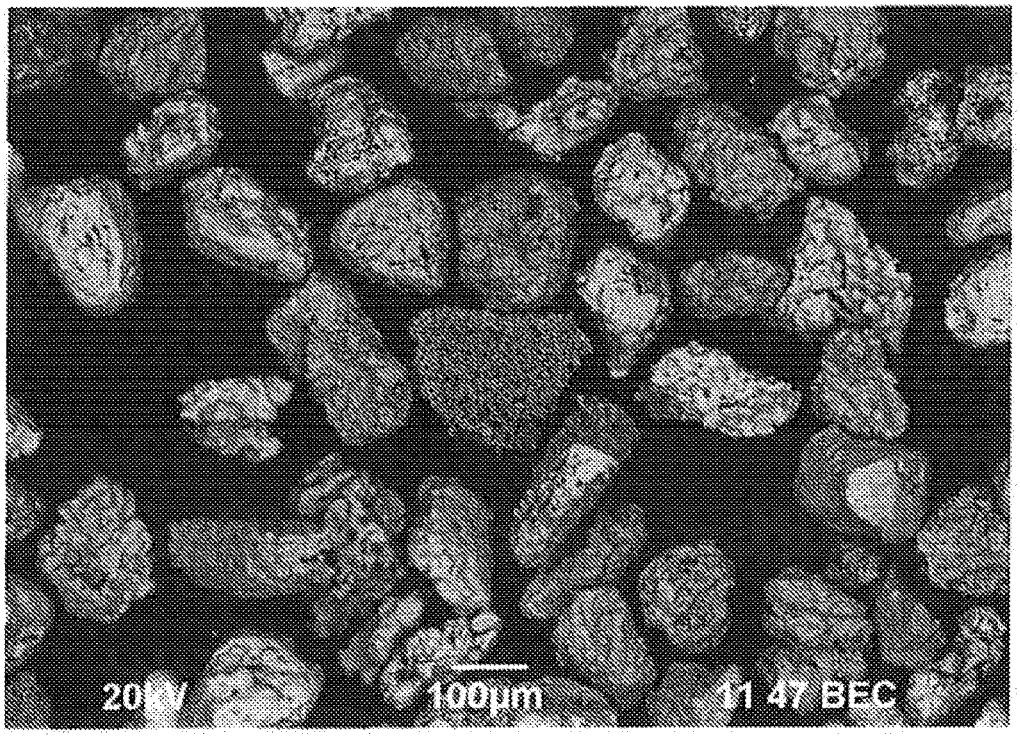
Figure 7:
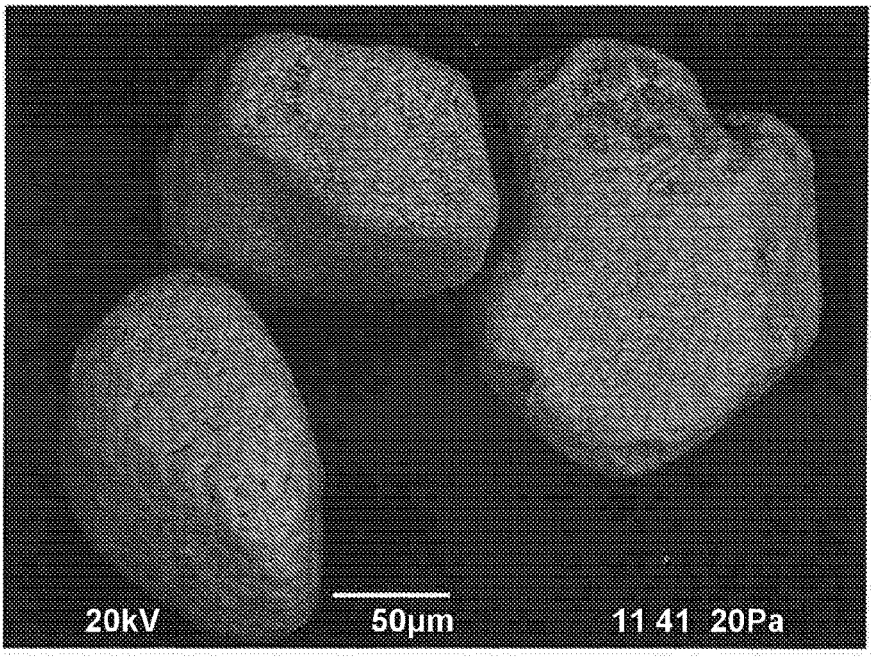
Figure 8:
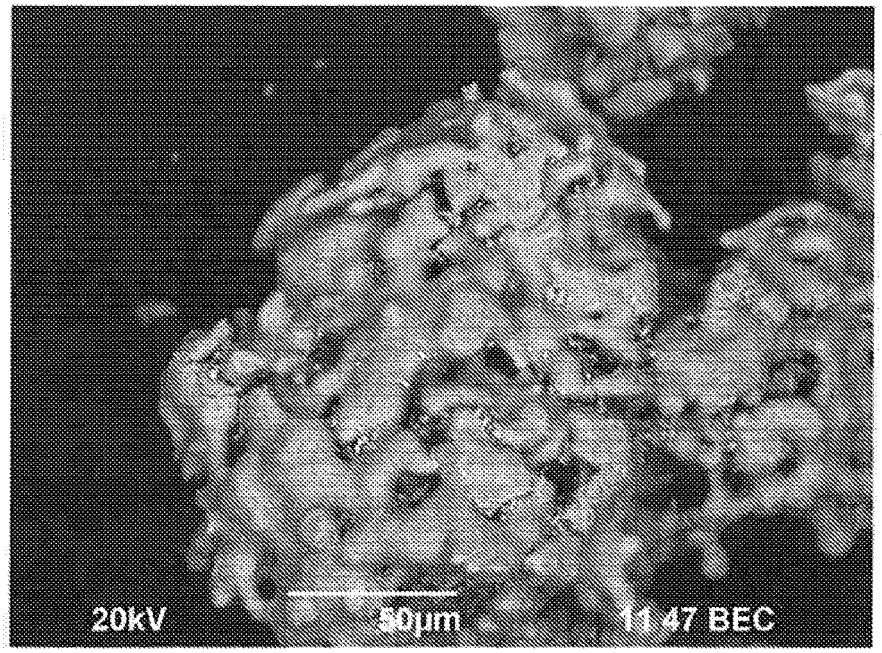

A specific embodiment of the invention will now be described with reference the accompanying drawings, in which;

FIG. 1 is a schematic diagram illustrating an electrolysis apparatus arranged for performing a method according to an embodiment of the invention, FIG. 2A is a schematic cross-sectional view illustrating additional detail of the cathode structure of the electrolysis apparatus of FIG. 1, FIG. 2B is a plan view of the cathode illustrated in FIG. 2A, FIGS. 3 and 4 are SEM (scanning electron micrography) micrographs illustrating particles of a rutile sand feedstock, FIGS. 5 and 6 are SEM micrographs illustrating metallic powder particles resulting from the reduction of a rutile sand feedstock using a method according to an embodiment of the invention, FIG. 7 is a SEM micrograph illustrating particles of a synthetic rutile feedstock, and FIG. 8 is an SEM micrograph illustrating titanium particles resulting from the reduction of a synthetic rutile feedstock.

FIG. 1 illustrates an electrolysis apparatus 10 configured for use in performing a reduction method embodying the invention. The apparatus comprises a stainless steel cathode 20 and a carbon anode 30 situated within a housing 40 of an electrolysis cell. The anode 30 is disposed above, and spatially separated from, the cathode 20. The housing 40 contains 500 kg of a calcium chloride based molten salt electrolyte 50, the electrolyte comprising $CaCl_2$ and 0.4 wt % CaO, and both the anode 30 and the cathode 20 are arranged in contact with the molten salt 50. Both the anode 30 and the cathode 40 are coupled to a power supply 60 so that a potential can be applied between the cathode and the anode.

The cathode 20 and the anode 30 are both substantially horizontally oriented, with an upper surface of the cathode 20 facing towards a lower surface of the anode 30.

The cathode 20 incorporates a rim 70 that extends upwards from a perimeter of the cathode and acts as a retaining barrier for a feedstock 90 supported on an upper surface of the cathode. The rim 70 is integral with, and formed from the same material as, the cathode. In other embodiments, the rim may be formed from a different material to the cathode, for example from an electrically insulating material.

The structure of the cathode may be seen in more detail in FIG. 2A and FIG. 2B. The rim 70 is in the form of a hoop having a diameter of 30 cm. A first supporting cross-member 75 extends across a diameter of the rim. The cathode also comprises a mesh-supporting member 71, which is in the form of a hoop having the same diameter as the rim 70. The mesh-supporting member has a second supporting cross-member 76 of the same dimensions as the supporting cross-member 75 on the rim 70. A mesh 80 is supported by being sandwiched between the rim 70 and the mesh-supporting member 71 (the mesh 80 is shown as the dotted line in FIG. 2A). The mesh 80 comprises a stainless steel cloth of mesh-size 100 that is held in tension by the rim 70 and the mesh-supporting member. The cross-member 75 is disposed against a lower surface of the mesh 80 and acts to support the mesh. An upper surface of the mesh 80 acts as the upper surface of the cathode.

The stainless steel cloth forming the mesh 80 is fabricated from 30 micrometer thick wires of 304 grade stainless steel that have been woven to form a cloth having square holes with a 150 micrometer opening. The mesh 80, cross-member 75 and rim 70 that form the cathode are all electrically conductive. In other embodiments, the mesh may be the only electrically conductive component of the cathode.

Example 1

A method embodying the invention will be illustrated with an example in which the feedstock to be reduced is a natural conventionally beneficiated rutile sand. Rutile is a naturally occurring mineral containing a high proportion (perhaps 94-96 wt %) of $TiO_2$. Rutile sand also contains many other elements and particles or grains of other non-rutile minerals. The skilled person will be aware of the compositions of typical rutile sands.

The rutile sand used in this specific example comprises grains of material having an average particle diameter as measured by laser diffraction (using a Malvern Mastersizer Hydro 2000MU) of about 200 micrometers and a bulk density of about 2.3 g/cm$^3$. The density of individual grains forming the sand may be in the range from about 4 g/cm$^3$ to about 7 g/cm$^3$, depending on the composition and crystal structure of each individual grain. FIG. 3 is a SEM micrograph illustrating the individual particles in the feedstock. The particles are mainly angular and predominantly $TiO_2$.

The SEM micrograph of FIG. 4 illustrates a polished section of some of the individual grains. The majority of the particles are imaged having a light grey colour 400 and are grains that are substantially $TiO_2$ (although there will be many impurity elements and each grain will have a slightly different composition). One of the grains is imaged as a lighter grey 410. This is a particle of zircon. Another grain has a darker grey colouring 420 and this is a grain with a high concentration of silicon indicating it is probably quartz.

About 3 kg of the feedstock 90, consisting of natural rutile sand, was arranged on the upper surface of the cathode 20 and in contact with the molten salt 50 (which consisted of $CaCl_2$ and 0.4 wt % CaO). Thus, the rutile sand 90 was supported by the mesh 80 of the cathode and retained at a depth of approximately 2 cm by the cathode-rim 70. The bed depth of the rutile is approximately 100 times the average particle diameter of the rutile sand particles.

The molten salt was maintained at a temperature of about 1000° C. and a potential was applied between the anode and the cathode. Thermal currents and gas lift effect generated by the buoyancy of the gases (which are predominantly CO and $CO_2$) generated at the anode cause the molten salt to circulate within the cell and generate flow through the bed of rutile supported on the cathode. The cell was operated in constant current mode, at a current of 400 A, for 52 hours. After this time, the cell was cooled and the cathode removed and washed to free salt from the reduced feedstock.

The reduced feedstock was removed from the cathode as a friable lump or cake of metallic powder particles that could be separated using light manual pressure. The lumps of material were tumbled in a barrelling tumbler containing alumina balls, and the material separated out into individual powder particles. These powder particles were then dried.

FIGS. 5 and 6 are SEM micrographs illustrating individual powder grains from the reduced sand. It can be seen that the metallic particles of the powder correspond in size and shape to the grains that formed the sand (the average particle size of the reduced material is slightly lower than the average particle size of the feedstock). Analysis revealed that the compositional differences between individual grains forming the feedstock were maintained in the individual grains forming the reduced powder. This suggests that each individual grain has been reduced individually to metal within the bed and that alloying between grains of different composition has not occurred.

Example 2

FIG. 7 is an SEM image showing synthetic rutile particles formed by treating ilmenite (by leaching as described above)

to remove unwanted elements. The particles are slightly porous when compared with natural rutile. A feedstock was prepared by sieving synthetic rutile particles and selecting the fraction falling between meshes of 63 microns and 212 microns.

1129 grams of the synthetic rutile feedstock was loaded onto the upper surface of a cathode and reduced as described above in relation to Example 1, except that the temperature of the salt was maintained at 980 degrees centigrade and the reduction proceeded for 50 hours. After reduction a powder was extracted and washed as described above.

FIG. 8 illustrates a titanium powder particle from the resulting powder. It can be seen that the general size and shape of the metallic particle is of the same order as the feedstock particles, but the metallic particle is more porous and has a slightly nodular shape.

Example 3

The following experiments were carried out to investigate the effect of different particle size ranges on progress of reduction. A rutile sand material was sourced from ABSCO Materials that comprised greater than 95% TiO2 and had a particle size range defined as a maximum of 4% of material retained on a 180 micron sieve. This material was taken by the applicant and sieved (using Retch brand sieves) into three fractions. The fractions were (1) particles having diameter less than 150 microns (i.e. particles that passed through a sieve having a mesh size of 150 microns), (2) particles having a diameter between 150 microns and 212 microns (i.e. particles that pass through a sieve of 212 micron mesh size but are retained by a sieve having 150 micron mesh size), and (3) particles having a diameter greater than 212 microns (i.e. particles that are retained by a sieve having a mesh size of 212 microns). Each of these three size fractions was used as a free-flowing particulate feedstock for reduction to metal. Particle size distribution was measured for each fraction using laser diffraction (Malvern Mastersizer Hydro 4000MU). These results are shown in table 1 below.

The reduction of each feedstock was carried out substantially as described above in relation to Example 1. Reduction was performed in a molten salt consisting of $CaCl_2$ with 0.6 wt % CaO held at a temperature of 950° C. Reduction was performed at a constant current of 400 A for a period of 68 hours. The distance between the cathode and the anode was set as 5 cm.

The bulk density and bed porosity for each feedstock were calculated, and the results are given in table 1 below. For these calculations it was assumed that the grains had the same density as $TiO_2$.

TABLE 1

Parameters of three rutile feedstocks having different particle sizes.

| Feed-stock | Sieve fraction (μm) | D10 (μm) | D50 (μm) | D90 (μm) | Bulk density (g/cm$^3$) | Bed porosity (%) |
|---|---|---|---|---|---|---|
| (1) | <150 | 108 | 156 | 225 | 2.30 | 45.6 |
| (2) | 150-212 | 121 | 180 | 267 | 2.38 | 43.7 |
| (3) | >212 | 205 | 280 | 382 | 2.44 | 42.3 |

After reduction for 68 hours, feedstock number 2 (150-212 micron size fraction) and feedstock number 3 (>212 micron size fraction) had reduced to discrete particles of titanium. Oxygen analysis on the titanium powder product of these reductions (using Eltra ON-900) showed that oxygen had been reduced to levels of between 3000 and 4500 ppm.

Feedstock number 1 (size fraction <150 micron), however, did not fully reduce, and did not form discrete particles of titanium. A metallic crust had formed on the top and bottom of the feedstock bed and the centre of the bed had converted to calcium titanates. This suggests that there was insufficient salt flow through the bed of feedstock 1. This may be attributable to the small size of the interstices between particles in feedstock 1, as compared with relatively larger interstices between particles in feedstock number 2 and number 3.

We claim:

1. A method for producing metallic powder comprising the steps of:

arranging a cathode and an anode in contact with a molten salt within an electrolysis cell, arranging a volume of feedstock comprising a plurality of non-metallic particles within the electrolysis cell, in which the volume of feedstock is arranged on an upper surface of the cathode and a lower surface of the anode is vertically spaced from the feedstock and the upper surface of the cathode, and in which the D90 particle size of the feedstock is no more than 100% greater than the D10 particle size of the feedstock and in which the particles making up the feedstock have an average particle diameter of less than 5 mm, and in which the feedstock has an average crystallite size that is greater than 10% of the average particle size, causing the molten salt to flow through the volume of feedstock, and applying a potential between the cathode and the anode such that the feedstock is reduced to metal.

2. The method according to claim 1, in which the D10 particle size for the feedstock is greater than 60 microns and the D90 particle size for the feedstock is lower than 3 mm.

3. The method according to claim 1, in which the feedstock is a bulk feedstock that has not been settled or compacted.

4. The method according to claim 1, in which the feedstock has a voidage of greater than 43%.

5. The method according to claim 1, in which the particles making up the feedstock are porous.

6. The method according to claim 1, in which the particles making up the feedstock have a density of between 3.5 g/cm$^3$ and 7.5 g/cm$^3$.

7. The method according to claim 1, in which the feedstock comprises a first set of particles having a composition in which a first metallic element forms the greater proportion by mass, and a second set of particles in which a second metallic element forms the greater proportion by mass, the feedstock being reduced under conditions such that there is no alloying between the first set of particles and the second set of particles.

8. The method according to claim 1, in which the feedstock comprises one or more naturally occurring minerals.

9. The method according to claim 8, in which the one or more minerals is one or more of rutile, ilmenite, anatase, leucoxene, scheelite, cassiterite, monazite, lanthanum, zircon, cobaltite, chromite, bertrandite, beryl, uranite, pitchblende, quartz, molybdenite or stibnite.

10. The method according to claim 1, in which the feedstock comprises a synthetic mineral.

11. The method according to claim 1, in which the feedstock comprises a first non-metallic particle having a first composition and a second non-metallic particle having a second composition, in which the feedstock is reduced under conditions such that the first non-metallic particle is reduced to a first metallic particle having a first metallic composition and the second non-metallic particle is reduced to a second metallic particle having a second metallic composition.

12. The method according to claim 1, in which the feedstock comprises more than 94% wt of $TiO_2$.

13. The method according to claim 1, in which the feedstock particles have an average diameter and the feedstock is loaded onto the upper surface of the cathode to a feedstock depth of between 10 and 500 times the average diameter of the feedstock particles.

14. The method according to claim 1, in which the feedstock particles comprise crystallites having an average crystallite diameter and the feedstock is loaded onto the upper surface of the cathode to a feedstock depth of between 10 and 500 times the average diameter of the feedstock crystallites.

15. The method according to claim 1, in which the upper surface of the cathode comprises a mesh having a mesh size smaller than the D10 particle size of the feedstock.

16. The method according to claim 1, in which the cathode comprises a retaining barrier allowing the feedstock to be supported on its upper surface to a depth of greater than 5 mm.

17. The method according to claim 16, in which the retaining barrier is a peripheral barrier.

18. The method according to claim 1, in which the feedstock is reduced with substantially no sintering between particles such that a powder can be recovered having an average diameter lower than an average diameter of the particles making up the feedstock.

19. The method according to claim 1, in which the reduced feedstock forms a friable mass of metallic particles that may be broken up to form the metallic powder, substantially each of the particles forming the metallic powder corresponding to one non-metallic particle in the feedstock.

20. The method according to claim 1, in which the feedstock consists of free-flowing discrete particles of non-metallic material.

21. The method according to claim 20, in which the free-flowing discrete particles have an average size (D50) of between 100 and 250 microns as measured by laser diffraction.

22. The method according to claim 1, in which the feedstock comprises synthetic rutile.

23. A method for producing metallic powder comprising the steps of:

arranging a cathode and an anode in contact with a molten salt within an electrolysis cell, arranging a volume of feedstock comprising a plurality of non-metallic particles within the electrolysis cell, in which the particles making up the feedstock are crystalline and have an average crystallite size of greater than 10 micrometers, causing the molten salt to flow through the volume of feedstock, and applying a potential between the cathode and the anode such that the feedstock is reduced to metal.

24. A method for producing metallic powder comprising the steps of:

arranging a cathode and an anode in contact with a molten salt within an electrolysis cell, arranging a volume of feedstock comprising a plurality of non-metallic particles within the electrolysis cell, in which the feedstock has an average crystallite size that is greater than 10% of the average particle size, causing the molten salt to flow through the volume of feedstock, and applying a potential between the cathode and the anode such that the feedstock is reduced to metal.

25. The method according to claim 24, in which the feedstock comprises a synthetic mineral.

26. The method according to claim 24, in which the feedstock comprises more than 94% wt of $TiO_2$.

27. The method according to claim 24, in which the feedstock is reduced with substantially no sintering between particles such that a powder can be recovered having an average diameter lower than an average diameter of the particles making up the feedstock.

28. The method according to claim 24, in which the reduced feedstock forms a friable mass of metallic particles that may be broken up to form the metallic powder, substantially each of the particles forming the metallic powder corresponding to one non-metallic particle in the feedstock.

29. The method according to claim 24, in which the feedstock consists of free-flowing discrete particles of non-metallic material.

30. The method according to claim 24, in which the feedstock comprises one or more naturally occurring minerals.

31. The method according to claim 30, in which the one or more minerals is one or more of rutile, ilmenite, anatase, leucoxene, scheelite, cassiterite, monazite, lanthanum, zircon, cobaltite, chromite, bertrandite, beryl, uranite, pitchblende, quartz, molybdenite or stibnite.

32. The method according to claim 24, in which the feedstock comprises synthetic rutile.

33. A method for producing metallic powder comprising the steps of:

arranging a cathode and an anode in contact with a molten salt within an electrolysis cell, arranging a volume of feedstock comprising a plurality of non-metallic particles within the electrolysis cell, in which the volume of feedstock is arranged on an upper surface of the cathode and a lower surface of the anode is vertically spaced from the feedstock and the upper surface of the cathode, and in which the D90 particle size of the feedstock is no more than 100% greater than the D10 particle size of the feedstock and in which the particles making up the feedstock have an average particle diameter of less than 5 mm, and in which the particles making up the feedstock are substantially free from porosity, causing the molten salt to flow through the volume of feedstock, and applying a potential between the cathode and the anode such that the feedstock is reduced to metal.

34. A method for producing metallic powder comprising the steps of:

arranging a cathode and an anode in contact with a molten salt within an electrolysis cell, arranging a volume of feedstock comprising a plurality of non-metallic particles within the electrolysis cell, in which the volume of feedstock is arranged on an upper surface of the cathode and a lower surface of the anode is vertically spaced from the feedstock and the upper surface of the cathode, and in which the D90 particle size of the feedstock is no more than 100% greater than the D10 particle size of the feedstock and in which the particles making up the feedstock have an average particle diameter of less than 5 mm, and in which the particles making up the feedstock are crystalline and have an average crystallite size of greater than 10 micrometers, causing the molten salt to flow through the volume of feedstock, and applying a potential between the cathode and the anode such that the feedstock is reduced to metal.

* * * * *